United States Patent [19]

Kissel et al.

[11] Patent Number: 4,966,791

[45] Date of Patent: Oct. 30, 1990

[54] METHODS FOR MANUFACTURING TEXTILE MATERIALS

[75] Inventors: Charles L. Kissel; Jay C. Selover, both of Anaheim; David M. Ingle, Temple City, all of Calif.

[73] Assignee: Union Oil Company of California, Los Angeles, Calif.

[21] Appl. No.: 408,133

[22] Filed: Sep. 14, 1989

Related U.S. Application Data

[62] Division of Ser. No. 838,532, Mar. 11, 1986, abandoned.

[51] Int. Cl.[5] ..... B05D 3/02

[52] U.S. Cl. ..... 427/389.9; 427/392; 428/262; 428/288; 428/290; 428/394; 523/222

[58] Field of Search ..... 427/389.9, 392; 428/262, 288, 290, 394; 523/222

[56] References Cited

U.S. PATENT DOCUMENTS

| | | | |
|---|---|---|---|
| 3,345,336 | 10/1967 | Kuhlkamp et al. | 525/328.6 |
| 3,459,790 | 8/1969 | Smith | 260/483 |
| 3,488,708 | 1/1970 | Smith | 96/84 |
| 3,554,987 | 1/1971 | Smith | 260/79.3 |
| 3,607,834 | 9/1971 | Marx et al. | 260/63 R |
| 3,658,878 | 4/1972 | Smith | 260/465.4 |
| 4,072,769 | 2/1978 | Lidel | 427/38 |
| 4,294,739 | 10/1982 | Upson et al. | 252/500 X |
| 4,408,018 | 10/1983 | Bartman | 525/300 |
| 4,421,889 | 12/1983 | Braun et al. | 524/381 |
| 4,427,632 | 1/1984 | Okaniwa et al. | 422/56 |
| 4,670,381 | 6/1987 | Frickey et al. | 435/7 |
| 4,704,440 | 11/1987 | Goulding et al. | 525/376 |
| 4,737,544 | 4/1988 | McCain et al. | 427/2 X |
| 4,855,349 | 8/1989 | Ingla | 524/432 |

FOREIGN PATENT DOCUMENTS 1144486 3/1969 United Kingdom .

1541909 3/1979 United Kingdom .

OTHER PUBLICATIONS

"Journal of Polymer Science: Polymer Symposium", D. A. Upson, John Wiley and Sons, Inc., 1985, 72, pp. 45–54.

"Stricter Benzene, Formaldehyde Limits", Science News, vol. 128, Nos. 25 and 26, Dec. 21 and 28, 1985, p. 397.

*Primary Examiner*—Michael Lusignan

*Attorney, Agent, or Firm*—Gregory F. Wirzbicki; Michael H. Laird

[57] ABSTRACT

Textile materials having improved physical properties comprise woven and/or non-woven fiber assemblies, the fibers of which are bound to a polymer composition containing polymerized carboxylic acid ester monomers and pendant functional groups attached to a polymer backbone and having the formula:

$$-R_1-\overset{\overset{\displaystyle O}{\|}}{C}-CH_2-X \qquad (1)$$

in which $R_1$ is a divalent organic radical at least 3 atoms in length, and X is organoacyl or cyano. Such polymers markedly increase wet and dry strengths and shape retention of textile materials, and they improve other physical properties without the necessity of employing formaldehyde-releasing monomers, such as the N-methylolamides, or cross-linking agents. Methods for producing such textile materials by applying solutions or dispersions of the described polymers to fiber assemblies are also provided. Aqueous dispersions of these polymers are particularly useful for the manufacture of loose-weaves, knits and non-wovens.

37 Claims, No Drawings

METHODS FOR MANUFACTURING TEXTILE MATERIALS

This application is a division of application Ser. No. 06/838,532, filed Mar. 11, 1986, now abandoned.

BACKGROUND OF THE INVENTION

1. Field of the Invention

This invention relates to the field of textile materials and to methods for manufacturing such materials.

2. Introduction

The field of textile materials involves all manufactured forms of fiber assemblies including wovens, nonwovens, knitted articles, threads, yarns, ropes, etc. which are employed, in one form or another, in almost every aspect of commercial and household use, either alone or as components of composite articles. All of these utilities place one or more similar demands on textile materials. Almost without exception, the textile material must have adequate tensile strength for its intended purpose, and such strength is often required under both wet and dry conditions The most common "wet" conditions to which textiles are exposed occur during manufacture, use, and cleaning and involve exposure to water, soap solutions, and/or dry cleaning solvents such as perchloroethylene. Textile materials exposed to flexing or tensile forces during manufacture, use, or cleaning require adequate flexibility, elongation (ability to stretch without breaking), and shape retention (ability to return to original dimensions after distortion). Since many textiles are exposed to wear during manufacture and use, they should possess adequate abrasion resistance, while those exposed to cleaning operations should have adequate scrub, solvent, and detergent resistance. Many textiles, such as clothing articles, drapes, and various household and commercial textiles, desirably have suitable "hand" (feel) for esthetic or utilitarian purposes. Many textiles also must be sufficiently stable, both chemically and physically, to heat, light, detergents, solvents, and other conditions of exposure to prevent variations in physical characteristics and/or discoloration, e.g. yellowing. Color stability, i.e., the retention of a textile's original color after exposure to heat, light, detergents, etc., is also desirable in many textile materials, particularly in those requiring esthetic appeal.

While all of these properties are, to a large extent, dependent upon the chemical composition of the fibers employed and their mechanical arrangement in the textile material, such properties can be, and often are, dependent upon the composition of chemicals, particularly polymeric binders, employed in their manufacture. Polymeric binders are widely employed to improve one or more physical properties of essentially all forms of textile materials. For instance, binders are used to improve shape retention, abrasion resistance, scrub resistance, and physical and chemical stability of woven and nonwoven textiles, knits, yarns, etc. The use of such binders to provide tensile strength as well as other desirable physical properties is a practical necessity in the manufacture of nonwoven textiles (also known as "formed" fabrics) which are usually characterized as webs or mats of random or oriented fibers bonded together with a cementing medium, such as starch, glue, or synthetic polymers. Synthetic polymers have largely displaced other bonding agents in the manufacture of nonwovens and other textile materials due primarily to improved physical properties they impart to the finished textile.

Synthetic polymers are typically applied to textile materials as solutions or as dispersions of the polymer in an aqueous medium. Such solutions and dispersions must, of course, possess properties which facilitate their use in textile manufacture. For instance, the solution or dispersion, as well as the polymer, must adequately wet the textile fibers to provide adequate distribution, coverage, and cohesiveness. Cohesiveness relates primarily to the ability of the polymer matrix to adhere to the textile fibers, particularly during manufacture and before curing has occurred. Rapid cure rate (the time required for the applied polymer to develop adequate strength in the textile material) is also important in manufacturing due to the demands of high speed manufacturing facilities. While curing catalysts, such as oxalic acid, are employed to cure some polymers, such as polymers which contain N-methylolamides, and they improve cure rate and physical properties, it is preferable, of course, to avoid the need for such catalysts. The necessity of catalyzing polymer curing increases cost and the technical complexity of textile manufacture and can result in the presence of undesirable toxic residues in the finished article.

The use of solvents other than water, while still widely practiced, is becoming more and more undesirable due to solvent expense and the costs and hazards involved in controlling solvent vapors. Yet solvents are still considered necessary to allow bonding of textile materials with polymers which cannot be employed in water-base systems Thus, water-base polymer latexes are much preferred in the textile manufacturing industry, provided that the necessary physical and chemical properties can be achieved. However, substantial loss of one or more physical properties often results upon substitution of water-base latexes for solvent-base polymers. Latexes of polymers containing N-methylolamide functional groups are known to improve physical properties in essentially all respects. However, such polymers release formaldehyde when cured, and they can result in formaldehyde residues in the finished product. Formaldehyde is coming under ever-increasing scrutiny in both the workplace and home; it is particularly undesirable in medical applications, feminine hygiene products, diapers, and similar articles. To illustrate, Japanese Law No. 112 of 1973 sets a maximum of 75 micrograms of formaldehyde per gram for all textiles used for any purpose and zero (non-detectible) for infant wear products. Similar laws have been proposed in the United States, and the state and federal Occupational Health and Safety Administrations (OSHA) have set stringent formaldehyde exposure limits for industrial workers.

Several rheological properties of water-base latexes are particularly important with regard to their utility in the manufacture of textile materials. For instance, control of latex particle size and particle size distribution is critical to the realization of desirable physical properties in many polymer latexes. Another factor, latex viscosity, can limit latex utility in textile manufacturing apparatus due to its influence on polymer distribution, filler loading, and fiber wetting.

Thus, it can be seen that the physical and chemical properties required in textile materials, and in the polymer solutions and dispersions employed to manufacture such materials, place various, sometimes conflicting, demands on the polymer system employed. Obviously, it is desirable to obtain a polymer system, preferably a water-base system, which possesses a wide range of properties desirable in the manufacture of textile materials.

SUMMARY OF THE INVENTION

It has now been found that textile materials having improved physical properties can be obtained by bonding assemblies of textile fibers with polymers containing polymerized, olefinically unsaturated carboxylic acid ester monomers and pendant functional groups of the formula $$-R_1-\overset{\overset{\displaystyle O}{\|}}{C}-CH_2-X \qquad (1)$$

wherein $R_1$ is a divalent organic radical at least 3 atoms in length, and X is organoacyl or cyano. The useful polymers can be applied to fiber assemblies either as solutions or aqueous dispersions, although aqueous dispersions are particularly preferred since they eliminate the costs and hazards associated with the use of polymer solvents. Such polymers can be employed to improve the physical properties of essentially all forms of textile materials including wovens, nonwovens, knits, threads, yarns, and ropes, and are particularly useful for the manufacture of nonwoven, knitted, and loose-weave materials. The polymers improve physical properties, including wet and dry tensile strength, of textile materials even in the absence of monomers, such as the N-methylolamides, which release formaldehyde upon curing. Nevertheless, the useful polymers may contain minor amounts of such monomers. In addition to improving wet and dry tensile strength, these polymers result in textile materials of improved abrasion resistance, color stability, scrub resistance, and physical stability (retention of physical strength) upon exposure to heat, light, detergent, and solvents. They have less tendency to yellow with age than do polymers containing other monomers, such as N-methylolacrylamide, often employed to increase tensile strength. The polymers exhibit increased cohesion to fibers containing polar function groups prior to, during, and after cure, and the finished textile materials have increased flexibility, elongation before break, and shape retention at comparable polymer loadings. Yet these improvements are not achieved at a sacrifice of other desirable properties such as flexibility and "hand" which often results from the use of polymer compositions and/or concentrations capable of significantly increasing strength and abrasion resistance. Thus, the finished textiles impart not only improved properties in one or more respects, they exhibit an improved balance of desirable properties as well.

The same is true of the polymer solutions and latexes employed in the textile manufacturing methods of this invention. Thus, latex viscosity, an important consideration in the manufacture of textile materials, is lower than that of otherwise identical latexes of polymers which do not contain the described functional monomers, and it is much less than that of otherwise identical N-methylolacrylamide (NMOA)-containing polymers. Furthermore, latex viscosity is influenced less by latex particle size or particle size distribution. Also, latex particle size and distribution have less, if any, effect on finished textile properties under otherwise identical conditions. Hence, latexes of various particle size and particle size distribution can be used in the same manufacturing process for producing the same textile articles less variation in latex performance or product properties, and it is not as necessary to control particle size or distribution from batch to batch. Since the latexes and solutions have lower viscosities (at similar solids contents), they can be employed for the manufacture of textile articles at higher filler and/or polymer concentrations without exceeding acceptable viscosity limits. Since curing catalysts and cross-linking agents, such as oxalic acid, multivalent complexing metals or metal compounds, glycols, etc., are not required to achieve adequate bonding, such materials can be eliminated from these compositions with commensurate reductions in expense and handling difficulties. Improved fiber wetting, particularly by the useful water-based polymer dispersions, and increased cure rate further facilitate both the ease and speed of textile manufacture. The variety of beneficial properties exhibited by both the methods and textile articles of this invention makes possible the manufacture of a multiplicity of textile materials with little or no reformulation of the useful polymer solutions or dispersions and thereby reduces the inventory of polymer materials required for the manufacture of such various products The physical properties of the finished textile are influenced by latex pH to a much lesser extent than is the case with other polymer latexes, such as N-methylolamide-containing polymer latexes. Latexes of N-methylolacrylamide-containing polymers produce maximum textile tensile strengths when applied to textile substrates at a pH of about 2, and finished article tensile strength decreases as pH is increased. This behavior of NMOA-containing polymers greatly limits the pH range within which they can be applied to textile fibers and results in the exposure of manufacturing and handling equipment to acidic corrosive latexes. In contrast, the finished tensile strengths obtained with the latexes useful in this invention changes much less with pH, generally increases as pH is increased from about 2 to about 7, and is typically maximum at a pH within the range of about 4 to about 8. Furthermore, the variation in final product tensile strength over the full pH range, i.e., from around 0.5 to 12, is much less significant than that observed with NMOA-containing polymers. Thus, the methods of this invention can be practiced over a much broader pH range without significant sacrifice of product tensile strength. For the same reason, these methods can be employed to treat acid-sensitive materials and can contain acid-sensitive components which might otherwise be degraded by exposure to acidic latexes.

DETAILED DESCRIPTION

Textile materials having improved physical properties are provided which comprise fiber assemblies containing a polymer having polymerized, olefinically unsaturated carboxylic acid ester groups and pendant functional groups of the formula:

$$-R_1-\overset{\overset{\displaystyle O}{\|}}{C}-CH_2-X \qquad (1)$$

wherein $R_1$ is a divalent organic radical at least 3 atoms in length, and X is organoacyl or cyano. Functional groups containing different $R_1$ and X radicals can be contained in the same polymer molecule, or polymers containing different $R_1$ and X groups can be blended in the same solution or dispersion. It is essential only that the useful polymers (1) contain carboxylic acid ester groups, (2) contain functional groups containing either two carbonyl groups or a carbonyl and a cyano group separated by a single methylene group, as illustrated, and (3) the methylene group is separated from the polymer main chain (backbone) by at least 4 atoms ($R_1$ plus the "interior" carbonyl group). Thus, $R_1$ is at least 3 atoms in length; i.e., the shortest link between the interior carbonyl group and the polymer backbone is at least 3 atoms long. Otherwise, the molecular weight, structure and elementary composition of $R_1$ does not negate the effectiveness of the dual keto or keto-cyano functionality of the pendant side chains. Thus, $R_1$ can be of any molecular weight sufficient to allow incorporation of the pendant functional groups into the polymer backbone, for instance, as part of a polymerizable olefinically unsaturated monomer or by substitution onto a preferred polymer by any suitable addition reaction, e.g.:

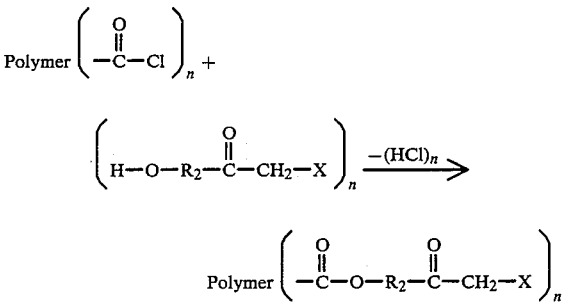

where n is an integer, and —O—$R_2$ is $R_1$ in expression (1), supra. $R_1$ can contain heteroatoms, such as oxygen, sulfur, phosphorus, and nitrogen, functional groups such as carbonyls, carboxy-esters, thio, and amino substituents, and can comprise aromatic, olefinic or alkynyl unsaturation. Typically, $R_1$ will be a cyclic or acyclic divalent organic radical of 3 to about 40 atoms in length; i.e., having 3 to about 40 atoms in its shortest chain between the polymer backbone and the interior carbonyl group. For ease of manufacture from readily available reactants, $R_1$ is preferably of the formula:

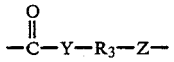

(2)

wherein Y and Z are independently selected from O, S, and $NR_7$, and $R_3$ is a divalent organic radical at least 1 atom in length, preferably 2 to about 40 and most preferably 2 to about 20 atoms in length. Y and Z are preferably O, and $R_7$ is H or a monovalent organic radical, preferably H or hydrocarbyl radical having up to 6 carbon atoms.

X is —CO—$R_4$ or —CN, preferably —CO—$R_4$ where $R_4$ is hydrogen or a monovalent organic radical preferably having up to 10 atoms other than hydrogen (i.e., up to 10 atoms not counting hydrogen atoms which may be present in the radical). Most preferably, $R_3$ is selected from substituted or unsubstituted alkylene, polyoxyalkylene, polythioalkylene and polyaminoalkylene up to about 40 atoms in length, preferably up to about 20 atoms in length The substituted and unsubstituted polythio-, polyoxy-, and polyamonioalkylenes can be readily formed by the well known condensation of alkylene oxides, alkylene amines, glycols, diamines, and dithiols. Thus:

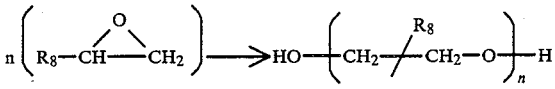

where $R_8$ is H or a monovalent organic radical, preferably H or alkyl radical. To illustrate, such pendant functional groups (formula 1) can be introduced into the polymer backbone by copolymerization of other monomers (discussed hereinafter) with a polymerizable monomer of the formula:

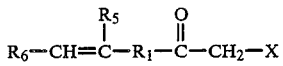

(3)

wherein X is as defined for formula 1, supra, $R_6$ and $R_5$ are independently selected from hydroxy, halo, thio, amino, and monovalent organic radicals, preferably having up to 10 atoms other than hydrogen, most preferably alkyl radicals having up to 10 carbons atoms. Substituting the preferred form of the group $R_1$ illustrated in formula 2 for $R_1$ in formula 1 yields the most preferred functional monomers:

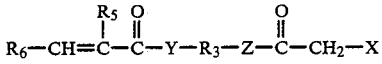

(4)

where $R_3$, $R_5$, $R_6$, X, Y and Z have the definitions given above. From this expression it can be seen that when $R_6$ is hydrogen, X is —CO—$R_4$, $R_4$ and $R_5$ are methyl, Y and Z are O, and $R_3$ is an ethylene radical, the resulting monomer is acetoacetoxyethylmethacrylate, one of the class of monomers described by Smith in U.S. Pat. No. 3,554,987, the disclosure of which is incorporated herein by reference in its entirety. This monomer can be prepared by first treating ethylene glycol with methyacrylic acid to form hydroxyethylmethacrylate which is then treated with diketene, as described by Smith, to form acetoacetoxyethylmethacrylate. A particularly preferred class of functional monomers, due to their relative availability, are those disclosed by Smith, which correspond to equation (4) in which $R_6$ is hydrogen, Y and Z are oxygen, $R_5$ is hydrogen or an alkyl group having up to 12 carbon atoms, $R_3$ is an alkylene group containing up to 10 carbon atoms, X is —CO—$R_4$ and $R_4$ is an alkyl group having up to 8 carbon atoms.

The useful polymers contain a sufficient amount of one or more of the described functional monomers to improve one or more physical properties of the finished textile material relative to a similar textile material containing a similar polymer absent such functional monomers. Generally, these polymers will contain at least about 0.5, often at least about 1 weight percent of the functional monomer based on total monomer content. Increasing the concentration of the described functional monomers to a level substantially above 20 weight percent generally does not produce significantly greater technical effects. Thus, functional monomer concentrations will usually be between about 0.5 to about 20 weight percent, typically about 0.5 to about 10 weight percent. Significant improvements in the physical properties described above usually can be achieved at functional monomer concentrations of about 0.5 to about 10 weight percent.

The useful functional monomers produce significant improvements in textile properties when employed with polymers which contain significant amounts of polymerized, olefinically unsaturated mono- and/or polycarboxylic acid esters. Thus, the polymers will usually contain at least about 10 weight percent, often at least about 20 weight percent, and preferably at least about 30 weight percent of olefinically unsaturated, carboxylic acid ester monomers other than the above-described functional monomers. The most preferred polymers contain at least about 50 weight percent, generally at least about 80 weight percent, of such ester monomers. Presently preferred ester monomers are esters of olefinically unsaturated mono- or dicarboxylic acids having up to 10 carbon atoms, and hydroxy-, amino-, or thio-substituted or unsubstituted alcohols, amines, and thiols having from 1 to about 30 carbon atoms, preferably 1 to about 20 carbon atoms, per molecule. Illustrative unsaturated carboxylic acids are acrylic, methacrylic, fumaric, maleic, itaconic, etc. Illustrative hydroxy-, amino-, and thio-substituted alcohols, amines, and thiols are glycerol, 1-hydroxy-5-thiododecane, 2-amino-5-hydroxyhexane, etc. Presently preferred esters, due primarily to cost and availability, are hydroxy-substituted and unsubstituted alcohol esters of acrylic and methacrylic acids such as butyl acrylate, 2-ethylhexyl acrylate, methyl methacrylate, hydroxyethyl acrylate, etc.

The described functional monomers and ester monomers can constitute the total polymer composition, or the portion of the polymer molecule not accounted for by those two monomer classes can be any polymerizable, olefinically unsaturated monomer or combination of monomers. Illustrative of such other polymerizable monomers are vinyl esters of carboxylic acids, the acid moiety of which contains from 1 to about 20 carbon atoms (e.g., vinyl acetate, vinyl propionate, vinyl isononoate); aromatic or aliphatic, alpha-beta-unsaturated hydrocarbons such as ethylene, propylene, styrene, and vinyl toluene; vinyl halides such as vinyl chloride and vinylidene chloride; olefinically unsaturated nitriles such as acrylonitrile; and olefinically unsaturated carboxylic acids having up to 10 carbon atoms such as acrylic, methacrylic, crotonic, itaconic, and fumaric acids, and the like. It has been found that minor amounts of olefinically unsaturated carboxylic acids and/or sulfoalkyl esters of such carboxylic acids significantly improve tensile strength and/or other physical properties of the finished textile material. Thus, it is presently preferred that the polymer contain at least about 0.1 weight percent, usually about 0.1 to about 10 weight percent, and preferably about 0.1 to about 5 weight percent of a polymerizable, olefinically unsaturated carboxylic acid having up to about 10 carbon atoms and/or a sulfoalkyl ester of such acids such as sulfoethyl methacrylate, sulfoethyl itaconate, sulfomethyl maleate, etc.

Although the useful polymers can contain other functional monomers such as N-methylolamides, e.g., N-methylolacrylamide (NMOA), it has been found that such other functional monomers are not essential to achieving acceptable physical properties in the finished textile materials and that the detriment associated with the presence of such monomers, such as formaldehyde released upon curing, can be avoided by minimizing the concentration of such N-methylolamides or eliminating them altogether. Thus, the preferred polymers contain less than about 1 percent, preferably less than about 0.5 percent, and most preferably no amount of N-methylolamide monomer units.

It has also been found that suitable physical properties of the finished textile article can be achieved without the need of cross-linking or hardening agents such as aldehyde hardeners (e.g., formaldehyde, mucochloric acid, etc.), cross-linking catalysts such as the strong base catalysts discussed by Bartman in U.S. Pat. No. 4,408,018, or acid catalysts such as phosphoric or methane sulfonic acid, complexing agents such as metals and metal compounds, or reactive monomers (e.g., glycols, polyamides, etc.). Since, to some extent, addition of such "hardening" agents increases the complexity and expense of polymer and/or textile manufacture, and since such agents are not required to achieve the desired physical properties with the polymers of this invention, the preferred polymers and finished textiles are preferably substantially free of such hardening agents or their residues. Nevertheless, minor amounts of such materials can be present in the useful polymer solutions or dispersions when their presence does not detrimentally affect desirable textile properties such as hand, flexibility, or elongation, and when the beneficial effect of such materials can be justified economically.

Aqueous dispersions and solvent-containing solutions of the useful polymers can be prepared by procedures known in the art to be suitable for the preparation of olefinically unsaturated carboxylic acid ester polymers, such as acrylic ester polymers. For instance, aqueous polymer dispersions can be prepared by gradually adding each monomer simultaneously to an aqueous reaction medium at rates proportionate to the respective percentage of each monomer in the finished polymer and initiating and continuing polymerization by providing in the aqueous reaction medium a suitable polymerization catalyst. Illustrative of such catalysts are free radical initiators and redox systems such as hydrogen peroxide, potassium or ammonium peroxydisulfate, dibenzoyl peroxide, lauryl peroxide, di-tertiarybutyl peroxide, bisazodiisobutyronitrile, either alone or together with one or more reducing components such as sodium bisulfite, sodium metabisulfite, glucose, ascorbic acid, erythorbic acid, etc. The reaction is continued with agitation at a temperature sufficient to maintain an adequate reaction rate until all added monomers are consumed. Monomer addition is usually continued until the latex (dispersion) reaches a polymer concentration of about 10 to about 60 weight percent. Physical stability of the dispersion is achieved by providing in the aqueous reaction medium, one or more surfactants (emulsifiers) such as non-ionic, anionic, and/or amphoteric surfactants. Illustrative of non-ionic surfactants are alkylpolyglycol ethers such as ethoxylation products of lauryl, oleyl, and stearyl alcohols or mixtures of such alcohols such as coconut fatty alcohol; alkylphenol polyglycol ethers such as ethoxylation products of octyl- or nonylphenol, diisopropyl-phenol, triisopropylphenol, di- or tritertiarybutylphenol, etc. Illustrative of anionic surfactants are alkali metal or ammonium salts of alkyl, aryl, or alkylaryl sulfonates, sulfates, phosphates, phosphonates, etc. Illustrative examples include sodium lauryl sulfate, sodium octylphenol glycolether sulfate, sodium dodecylbenzene sulfonate, sodium lauryldiglycol sulfate, and ammonium tritertiarybutylphenol, penta- and octa-glycol sulfates. Numerous other examples of suitable ionic, nonionic and amphoteric surfactants are disclosed in U.S. Pat. Nos. 2,600,831, 2,271,622, 2,271,623, 2,275,727, 2,787,604, 2,816,920, and 2,739,891, the disclosures of which are incorporated herein by reference in their entireties.

Protective colloids may be added to the aqueous polymer dispersion either during or after the reaction period. Illustrative protective colloids include gum arabic, starch, alginates, and modified natural substances such as methyl-, ethyl-, hydroxyalkyl-, and carboxymethyl cellulose, and synthetic substances such as polyvinyl alcohol, polyvinyl pyrrolidone, and mixtures of two or more of such substances. Fillers and/or extenders such as dispersible clays and colorants, such as pigments and dyes, can also be added to the aqueous dispersions either during or after polymerization.

One additional advantage of the polymers useful in this invention is that their solutions and dispersions, and particularly their dispersions in aqueous media, are of lower viscosity than are ester polymers not containing the functional monomers useful in this invention, and they have much lower viscosities than N-methylolamide-containing polymer dispersions. Thus, the latexes have viscosities of about 100 centipoise or less, often about 50 centipoise or less measured at 21° C. at polymer concentration of 40 weight percent or more and even of 50 weight percent and more. Polymer concentrations of about 40 to about 70 percent encompass most latexes resulting from emulsion polymerization, while preferred latexes typically have solids contents of about 40 to about 60 weight percent polymer solids The observed low viscosity behavior of the concentrated latexes is atypical, particularly for polymers having comparable molecular weights and for latexes of comparable particle size. These polymers usually have number average molecular weights of at least about 40,000 and most often at least about 50,000. Typically, polymer molecular weight maximums are about 150,000 or less, generally about 100,000 or less. The dispersed polymer particles in the latex can be of any size suitable for the intended use although particle sizes of at least about 120 nanometers are presently preferred since latex viscosity increases as particle size is reduced substantially below that level. Most often, the described latexes will have polymer particle sizes within the range of about 120 to about 300 nanometers as determined on the N-4 "Nanosizer" available from Coulter Electronics, Inc., of Hialeah, Fla. Accordingly, the polymer content of both the aqueous dispersions and solutions can be increased or the loading of the dispersions and solutions with fillers such as clays, pigments, and other extenders can be increased without exceeding permissible viscosity limits. For instance, aqueous dispersions and polymer solutions can contain more than 2 percent, often more than 5 percent, and even more than 10 percent fillers, colorants and/or extenders.

Solutions of the useful polymers can be prepared by polymerizing the selected monomers as described above in solvents in which both the monomers and the polymers are soluble. Suitable solvents include aromatic solvents such as xylene and toluene and alcohols such as butanol. Polymerization initiators and reducing components, when employed, should be soluble in the selected solvent or mixture of solvents. Illustrative polymerization initiators soluble in the noted organic solvents include dibenzoyl peroxide, lauryl peroxide, and bisazodiisobutyronitrile. Erythorbic and ascorbic acids are illustrative of reducing components soluble in polar organic solvents.

Textile substrates useful in the articles and methods of this invention include assemblies of fibers, preferably fibers which contain polar functional groups. Significantly greater improvements in tensile strength and other physical properties are achieved by application of the useful polymers to natural or synthetic polar group-containing fibers in contrast to relatively nonpolar fibers such as untreated, nonpolar polyolefin fibers. However, such nonpolar fibers also can be employed. Furthermore, polar groups, such as carbonyl (e.g., keto) and hydroxy groups, can be introduced into polyolefins, styrene-butadiene polymers and other relatively nonpolar fibers by known oxidation techniques, and it is intended that such treated polymers can be employed in the articles and methods of this invention.

For the purposes of this invention, it is intended that the term "fibers" encompass relatively short filaments or fibers as well as longer fibers often referred to as "filaments." Illustrative polar functional groups contained in suitable fibers are hydroxy, etheral, carbonyl, carboxylic acid (including carboxylic acid salts), carboxylic acid esters (including thio esters), amides, amines etc. Essentially all natural fibers include one or more polar functional groups. Illustrative are virgin and reclaimed cellulosic fibers such as cotton, wood fiber, coconut fiber, jute, hemp, etc., and protenaceous materials such as wool and other animal fur. Illustrative synthetic fibers containing polar functional groups are polyesters, polyamides, carboxylated styrene-butadiene polymers, etc. Illustrative polyamides include nylon-6, nylon-66, nylon-610, etc.; illustrative polyesters include "Dacron," "Fortrel," and "Kodel"; illustrative acrylic fibers include "Acrilan," "Orlon," and "Creslan." Illustrative modacrylic fibers include "Verel" and "Dynel." Illustrative of other useful fibers which are also polar are synthetic carbon, silicon, and magnesium silicate (e.g., asbestos) polymer fibers and metallic fibers such as aluminum, gold, and iron fibers.

These and other fibers containing polar functional groups are widely employed for the manufacture of a vast variety of textile materials including wovens, nonwovens, knits, threads, yarns, and ropes. The physical properties of such articles, in particular tensile strength, abrasion resistance, scrub resistance, and/or shape retention, can be increased by addition of the useful polymers with little or no degradation of other desirable properties such as hand, flexibility, elongation, and physical and color stability, The useful polymers can be applied to the selected textile material by any one of the procedures employed to apply other polymeric materials to such textiles. Thus, the textile can be immersed in the polymer solution or dispersion in a typical dip-tank operation, sprayed with the polymer solution or dispersion, or contacted with rollers or textile "printing" apparatus employed to apply polymeric dispersions and solutions to textile substrates. Polymer concentration in the applied solution or dispersion can vary considerably depending primarily upon the application apparatus and procedures employed and desired total polymer loading (polymer content of finished textile). Thus, polymer concentration can vary from as low as about 1 percent to as high as 60 percent or more, although most applications involve solutions or dispersions containing about 5 to about 60 weight percent latex solids.

Textile fiber assemblies wetted with substantial quantities of polymer solutions or latexes are typically squeezed with pad roll, knip roll, and/or doctor blade assemblies to remove excess solution or dispersion and, in some instances, to "break" and coalesce the latex and improve polymer dispersion and distribution and polymer-fiber wetting. The polymer-containing fiber assembly can then be allowed to cure at ambient temperature by evaporation of solvent or water although curing is typically accelerated by exposure of the polymer-containing fiber assembly to somewhat elevated temperatures such as 90° C. to 200° C. One particular advantage of the useful polymers is that they cure relatively fast. Thus, bond strength between the polymer and fibers, and thus, between respective fibers, develops quickly. Rapid cure rate is important in essentially all methods of applying polymers to textiles since it is generally desirable to rapidly reduce surface tackiness and increase fiber-to-fiber bond strength. This is particularly true in the manufacture of loose woven textiles, knits, and nonwovens including all varieties of paper. Most often, adequate bond strength and sufficiently low surface tackiness must be achieved in such textiles before they can be subjected to any significant stresses and/or subsequent processing. While cure rate can be increased with more severe curing conditions, i.e., using higher temperatures, such procedures require additional equipment, increased operating costs, and are often unacceptable due to adverse effects of elevated temperatures on the finished textile.

The polymer content of the finished textile can vary greatly depending on the extent of improvement in physical properties desired. For instance, very minor amounts of the useful polymers are sufficient to increase tensile strength, shape retention, abrasion resistance (wear resistance), and/or wet-scrub resistance of the textile fiber assembly. Thus, polymer concentrations of at least about 0.1 weight percent, generally at least about 0.2 weight percent, are sufficient to obtain detectable physical property improvements in many textiles. However, most applications involve polymer concentrations of at least about 1 weight percent and preferably at least about 2 weight percent based on the dry weight of the finished polymer-containing textile article. Polymer concentrations of about 1 to about 95 weight percent can be employed, while concentrations of about 1 to about 30 weight percent based on finished textile dry weight are most common.

The product property in which the most significant improvement results depends, at least to some extent, on the structure of the treated fiber assemblage. For instance, threads and ropes formed from relatively long, tightly wound or interlaced fibers and tightly woven textiles generally possess significant tensile strength in their native state, and the percentage increase in tensile strength resulting from polymer treatment will be less, on a relative basis, than it is with other products such as loose-wovens, knits, and non-wovens. More specifically, significant improvements in abrasion resistance and scrub resistance are achieved in threads, ropes, and tightly woven textiles, and significant improvement in tensile strength (both wet and dry) can be realized in such products which are manufactured from relatively short fibers and which thus have a relatively lower tensile strength in their native form. Usually the most significant improvements sought in loose-woven textiles are shape retention (including retention of the relative spacing of adjacent woven strands), abrasion resistance, and scrub resistance, and these improvements can be achieved by the methods and with the articles of this invention. Similar improvements are also obtained in knitted fabrics.

The most significant advantages of the useful methods and textile articles are in the field of non-wovens. Non-wovens depend primarily on the strength and persistence of the fiber-polymer bond for their physical properties and for the retention of such properties with use. Bonded non-woven fabrics, such as the textile articles of this invention, can be defined generally as assemblies of fibers held together in a random or oriented web or mat by a bonding agent. While many non-woven materials are manufactured from crimped fibers having lengths of about 0.5 to about 5 inches, shorter or longer fibers can be employed. The utilities for such non-wovens range from hospital sheets, gowns, masks, and bandages to roadbed underlayment supports, diapers, roofing materials, napkins, coated fabrics, papers of all varieties, tile backings for ungrouted tile prior to installation), and various other utilities too numerous for detailed listing. Their physical properties range all &he way from stiff, board-like homogeneous and composite paper products to soft drapeable textiles (e.g., drapes and clothing), and wipes The myriad variety of non-woven products can be generally divided into categories characterized as "flat goods" and "highloft" goods, and each category includes both disposable and durable products. Presently, the major end uses of disposable flat goods non-wovens include diaper cover stock, surgical drapes, gowns, face masks, bandages, industrial work clothes, and consumer and industrial wipes and towels such as paper towels, and feminine hygiene products. Current major uses of durable flat goods non-wovens include apparel interlinings and interfacings, drapery and carpet backings, automotive components (such as components of composite landau automobile tops), carpet and rug backings, and construction materials, such as roadbed underlayments employed to retain packed aggregate, and components of composite roofing materials, insulation, pliable or flexible siding and interior wall and ceiling finishes, etc.

The so-called "highloft" non-wovens can be defined broadly as bonded, non-woven fibrous structures of varying bulks that provide varying degrees of resiliency, physical integrity, and durability depending on end use. Currently, major uses of highloft non-wovens include the manufacture of quilts, mattress pads, mattress covers, sleeping bags, furniture underlayments (padding), air filters, carpet underlayments (e.g., carpet pads), winter clothing, shoulder and bra pads, automotive, home, and industrial insulation and paddings, padding and packaging for stored and shipped materials and otherwise hard surfaces (e.g., automobile roof tops, chairs, etc.), floor care pads for cleaning, polishing, buffing, and stripping, house robes (terrycloth, etc.), crib kick pads, furniture and toss pillows, molded packages, and kitchen and industrial scrub pads.

The useful polymers and methods can be used to manufacture all such non-wovens, and they are particularly useful for the manufacture of non-wovens free of, or having reduced levels of, formaldehyde or other potentially toxic components and which have relatively high wet and dry tensile strength, abrasion resistance, color stability, stability to heat, light, detergent, and solvents, flexibility, elongation, shape retention, and/or acceptable "hand." They are also particularly useful in manufacturing methods which require relatively short cure time (rapid bonding rate), relatively high polymer-to-fiber cohesion, temperature stability (during curing and subsequent treatment), and/or the use of slightly acidic, neutral or alkaline application solutions or dispersions.

The invention is further described by the following examples which are illustrative of specific modes of practicing the invention and are not intended as limiting the scope of the invention as defined by the appended claims.

EXAMPLE 1

An acrylate polymer containing 35.5 weight percent methyl acrylate, 63.5 weight percent ethyl acrylate, and 1 weight percent itaconic acid is prepared as follows:

A monomer-surfactant pre-emulsion is prepared by emulsifying 131.6 grams deionized water, 6.1 grams itaconic acid, 11.2 grams of a polyethoxylated nonylphenol surfactant having 50 moles of ethylene oxide per mole, 11.2 grams of a polyethoxylated nonylphenol surfactant having 40 moles of ethylene oxide per mole, 13.6 grams of a polyethoxylated nonylphenol surfactant having 9 moles of ethylene oxide per mole, 216.1 grams methyl acrylate, and 386.8 grams of ethyl acrylate. The reactor is initially charged with 300.3 grams water and 30 ml. of the monomer-surfactant pre-emulsion, and the resulting mixture is purged with nitrogen That mixture is then heated to 51.7° C. and 0.6 grams of potassium peroxydisulfate and 0.6 grams of sodium metabisulfite are added with mixing after which the mixture is heated to 61.1° C. to initiate the reaction The remainder of the monomersurfactant pre-emulsion, 35 ml. of a solution formed by dissolving 2.62 grams of potassium peroxydisulfate in 100 ml. deionized water and 35 ml. of a solution formed by dissolving 2.4 grams of sodium metabisulfite in 100 ml. deionized water are gradually metered into the agitated reactor over a period of 4 hours. The reaction medium is maintained at 61.1° C. throughout the run. Completion of the reaction is assured by post-addition of 0.8 grams ammonium hydroxide, 0.12 grams potassium peroxydisulfate, and 0.2 grams of sodium metabisulfite, and the polymer emulsion is stabilized with 0.96 grams of 1,2-dibromo-2-4-dicyanobutane biocide.

EXAMPLE 2

Chromatographic grade filter paper is saturated with the polymer latex of Example 1 and oven-dried at 150° C. for 3 minutes to form an impregnated paper sample containing 3.1 weight percent polymer. A 1-inch by 4-inch section of this sample is tested for wet tensile strength by dipping in percent "Aerosol OT" solution for 4 seconds and measuring tensile on an Instron Model 1122. (Aerosol OT is a surfactant manufactured by American Cyanamid, Inc.) A wet tensile strength of 1.8 is obtained. A similar sample of the cured filter paper is tested for tensile strength after treatment with perchloroethylene by dipping in neat perchloroethylene for 4 seconds and measuring tensile on the Instron Model 122. A tensile strength of 3.2 is obtained These results are summarized in Table 1.

EXAMPLE 3

A polymer emulsion containing 54.2 weight percent polymer solids is produced as described in Example 1 with the exception that an amount of N-methylolacrylamide is added to the monomer-surfactant pre-emulsion sufficient to introduce 4 weight percent N-methylolacrylamide into the finished polymer. The concentration of the remaining monomers in the polymer is thus reduced proportionately to obtain a polymer containing about 1 weight percent itaconic acid, 4 weight percent N-methylolacrylamide, 34 weight percent methyl acrylate, and 1 weight percent ethyl acrylate. The polymer emulsion is tested for wet and PCE (perchloroethylene) tensiles as described in Example 2 at a loading of 19 weight percent polymer solids on the filter paper samples, and these results are summarized in Table 1.

EXAMPLE 4

An acetoacetoxyethylacrylate-containing polymer is prepared using the compositions and procedures described in Example 1 with the exception that sufficient acetoacetoxyethylacrylate is added to the monomer-surfactant pre-emulsion to obtain a finished polymer containing 4 weight percent of that monomer. Remaining monomer concentrations are reduced proportionately to about 1 weight percent itaconic acid, 34 percent methyl acrylate, and 61 weight percent ethyl acrylate. The polymer emulsion is evaluated for wet and PCE tensiles as described in Example 2, and the results are reported in Table 1.

EXAMPLE 5

An acetoacetoxyethylmethacrylate-containing polymer is prepared employing the compositions and procedures described in Example 1 with the exception that sufficient acetoacetoxyethylmethacrylate is added to the monomer-surfactant pre-emulsion to obtain a finished polymer composition containing 4 weight percent of &hat monomer The remaining monomer concentrations are reduced proportionately to about 1 weight percent itaconic acid, 34 percent methyl acrylate, and 61 weight percent ethyl acrylate. Wet and PCE tensiles are determined as described in Example 2, and the results are reported in Table 1.

TABLE 1

| Ex. No. | Added Monomer Wt. % | Latex pH | Polymer Loading Wt. % | (a) MWn × 1,000 | Tensile, lb. Wet | Tensile, lb. PCE | (b) % Solids | (c) Vis., Cp., 21° C. |
|---|---|---|---|---|---|---|---|---|
| 2 | none | 5.3 | 23.1 | 25 | 1.8 | 3.2 | 56 | 62 |
| 3 | NMOA, 4% | 6.4 | 19.0 | | 9.7 | 9.3 | 54 | 950 |
| 4 | AAEA, 4% | 5.4 | 21.6 | 101 | 5.0 | 7.4 | 54 | 24 |
| 5 | AAEMA, 4% | 4.5 | 21.7 | 69 | 5.3 | 7.0 | 56 | 58 |

(a) MWn = number average molecular weight.
(b) % Solids = weight percent nonvolatile matter.
(c) Viscosity in centipoise at 21° C.

These results demonstrate that minor amounts of the useful functional monomers significantly increase both wet and PCE tensile as compared to identical polymers not containing such functional monomers. While the tensile strengths obtained with the useful functional monomers are not equivalent to those obtained with the NMOA-containing polymer under the conditions of these evaluations, they are competitive with such polymers in many circumstances and avoid the use of formaldehyde-releasing materials.

EXAMPLE 6

A stock polymer of itaconic acid, acrylamide, butyl acrylate and ethyl acrylate is prepared as follows: A surfactant-monomer pre-emulsion is formed by emulsifying 5.3 grams itaconic acid, 10.6 grams acrylamide, 251.7 grams butyl acrylate, 255.8 grams ethyl acrylate, 32.7 grams polyethoxylated nonylphenol surfactant containing 40 moles ethylene oxide per mole, 10.6 grams polyethoxylated nonylphenol surfactant containing 50 moles ethylene oxide per mole, and 4.5 grams sodium lauryl sulfate surfactant (30 percent active) in 133.6 grams water. The reactor is initially charged with 353.4 grams deionized water and 1.1 grams dissolved ammonium hydrogen phosphate to which 70 ml. of the monomer-surfactant pre-emulsion is then added. The resulting mixture is purged with nitrogen and heated to about 43° C. Sodium metabisulfite (0.45 grams) and potassium peroxydisulfate (0.72 grams) are then added with agitation, and the reactor is allowed to exotherm to 60° C. The remainder of the monomer-surfactant pre-emulsion is then gradually metered into the reactor along with 57 ml. of a solution formed by dissolving 4.8 grams of potassium peroxydisulfate in 100 ml. water and 31 ml. of a solution by dissolving 4.4 grams sodium metabisulfite in 100 ml. water over a period of 3 hours. Reactor temperature is maintained at 60° C. throughout the reaction. Tertiarybutyl hydroperoxide (0.4 grams) is then added to assure polymerization of all monomers. The resulting latex has a latex solids content of 48.4 weight percent, a pH of 2.9, and a polymer composition of 1 weight percent itaconic acid, 2 weight percent acrylamide, 48 weight percent butyl acrylate, and 49 weight percent ethyl acrylate. The ability of this polymer latex to improve the wet and PCE tensile of nonwovens is evaluated as described in Example 2, and the results are reported in Table 2.

EXAMPLE 7

A latex of a polymer containing 4 weight percent N-methylolacrylamide is prepared by employing the compositions and procedures described in Example 6 with the exception that sufficient N-methylolacrylamide is added to the monomer-surfactant pre-emulsion to obtain 4 weight percent NMOA in the finished polymer Inclusion of the NMOA monomer proportionately reduces the concentration of other monomers to about 1 weight percent itaconic acid, 1.9 weight percent acrylamide, 46.1 weight percent butylacrylate, and 47 weight percent ethyl acrylate. All other compositions and conditions are as described in Example 6. The resulting latex is employed to impregnate samples of non-woven filter paper which are cured and tested for wet and PCE tensile strength as described in Example 2. The results are reported in Table 2.

EXAMPLE 8

A latex of a polymer containing 4 weight percent aoetoacetoxyethylacrylate (AAEA) is prepared using the compositions and procedures described in Example 6 with the exception that sufficient AAEA is incorporated in the monomersurfactant pre-emulsion to form a polymer containing 4 weight percent of that monomer. The concentration of other monomers is reduced proportionately to about 1 weight percent itaconic acid, 1.9 weight percent acrylamide, 46.1 weight percent butyl acrylate, and 47 weight percent ethyl acrylate. All other compositions and conditions are as described in Example 6. The resulting latex is employed to impregnate non-woven filter paper, and wet and PCE tensiles are obtained as described in Example 2. The results are reported in Table 2.

TABLE 2

| Ex. No. | Added Monomer Wt. % | Latex pH | Polymer Loading Wt. % | Tensile, lb. Wet | Tensile, lb. PCE | % Solids | Visc. Cp., 21° C. |
|---|---|---|---|---|---|---|---|
| 6 | none | 2.9 | 19.8 | 4.3 | 4.4 | 48 | 38 |
| 7 | NMOA, 4% | 3.1 | 20.3 | 8.2 | 8.9 | 48 | 230 |
| 8 | AAEA, 4% | 3.1 | 18.8 | 5.8 | 7.4 | 49 | 22 |

EXAMPLE 9

A stock latex of a polymer of itaconic acid, acrylamide, ethyl acrylate, butyl acrylate, and acrylonitrile is prepared as follows A monomer pre-emulsion is prepared by blending 287.4 grams deionized water, 14.4 grams of a blend of C14-C16 sodium alkylsulfonates, 3.2 grams itaconic acid, 3.2 grams acrylamide, 196 grams ethyl acrylate, 363 grams butyl acrylate, and 31 grams acrylonitrile The reactor is charged with 281.4 grams water and 70 ml. of the monomer-surfactant pre-emulsion, purged with nitrogen and heated to 65.6° C. Gradual addition of catalyst (2.4 grams sodium persulfate and 0.6 grams sodium bicarbonate dissolved in 60 grams water) and activator 2.4 grams erythorbic acid dissolved in 60 grams water) is then commenced, and reactor temperature was allowed to exotherm to 71.1° C. Delay addition of the remaining pre-emulsion solution is then commenced and is continued along with continued catalyst and activator solution additions for 3 hours after which the entire pre-emulsion and 45 ml. of each of the catalyst and activator solutions have been added. Tertiary butyl hydro. peroxide (0.6 grams) and 0.3 grams of erythorbic acid are added to the reactor to assure complete reaction The resulting polymer contains 0.53 weight percent itaconic acid, 0.53 weight percent acrylamide, 32.8 weight percent ethyl acrylate, 60.9 weight percent butylacrylate, and 5.2 weight percent acrylonitrile. Nine separate portions of this latex are isolated and the pH of each is adjusted to 2, 3, 4, 5, 6, 7, 8, 9, or 10. The pH-adjusted latex samples are then employed to impregnate non-woven filter paper as described in Example 2, and wet tensile strengths for each impregnated, cured paper sample are evaluated as described in Example 2 The values for these determinations at a polymer-loading level of 16 weight percent are reported in Table 3.

EXAMPLE 10

An N-methylolacrylamide-containing polymer latex is prepared using the compositions and procedures described in Example 9 with the exception that 17.9 grams of N-methylolacrylamide are added to the monomer-surfactant pre-emulsion and the concentration of the other monomers is reduced proportionately to retain the same total monomer concentration. Portions of the resulting latex are adjusted to pH levels and tested for wet tensile values as described in Example 9. The results of these evaluations are reported in Table 3.

EXAMPLE 11

An acetoacetoxyethylacrylate polymer is prepared employing the compositions and procedures described in Example 9 with the exception that 17.9 grams acetoacetoxyethylacrylate is added to the monomer-surfactant pre-emulsion and the weights and percentages of other monomers are reduced proportionately to maintain the same total monomer concentration reported in Example 9. Portions of the resulting latex are adjusted for pH and evaluated for wet tensile values as described in Example 9. These results are reported in Table 3.

EXAMPLE 12

An acetoacetoxyethylmethacrylate-containing polymer latex is prepared as described in Example 9 with the exception that 17.9 grams of acetoacetoxyethylmethacrylate are added to monomer-surfactant pre-emulsion and the concentrations of other monomers are reduced proportionately to maintain the same total monomer content. Portions of the resulting latex are adjusted to the pH values and evaluated for wet tensile strength as described in Example 9. These results are reported in Table 3.

TABLE 3

| Ex. No. | Added Monomer | Wet Tensile in lb. at pH 2 | 3 | 4 | 5 | 6 | 7 | 8 | 9 | 10 |
|---|---|---|---|---|---|---|---|---|---|---|
| 9 | None | 3.5 | 3.7 | 3.8 | 3.5 | 3.5 | 3.5 | 3.7 | 3.5 | 2.7 |
| 10 | NMOA, 3% | 8.6 | 6.6 | 6.6 | 6.9 | 6.8 | 6.1 | 5.1 | 4.3 | 3.8 |
| 11 | AAEA, 3% | 6.1 | 6.0 | 6.0 | 5.7 | 5.7 | 5.9 | 5.7 | 5.4 | 5.1 |
| 12 | AAEMA, 3% | 5.0 | 4.9 | 5.3 | 6.0 | 6.3 | 5.9 | 5.8 | 5.2 | 5.0 |

These results demonstrate that the acetoacetoxy-monomer-containing polymers are superior, throughout the pH range tested, to the stock polymer and are comparable or superior to the NMOA-containing polymer at pH values of 7 and above under otherwise identical conditions.

EXAMPLE 13

An acetoacetoxyethylmethacrylate-containing polymer is prepared using the compositions, procedures, and conditions described in Example 9 with the exception that 29.2 grams of acetoactoxyethylmethacrylate (AAEMA) are added to the monomer-surfactant pre-emulsion. The added weights of the remaining monomers were reduced proportionately to maintain the same total monomer weight. The finished polymer contains 0.5 weight percent itaconic acid, 0.5 weight percent acrylamide, 5.0 weight percent acetoacetoxyethylmethacrylate, 31.2 weight percent ethyl acrylate, 57.9 weight percent butyl acrylate, and 4.9 weight acrylonitrile. A portion of this latex is employed to impregnate non-woven filter paper samples as described in Example 2 at the pH of the unaltered latex (2.7) and at pH 6, and tensile values (both wet and in perchloroethylene) are obtained as described in Example 2. The results are reported in Table 4.

EXAMPLE 14

A polymer latex is prepared as described in Example 13 with the exception that 29.2 grams of acetoacetoxymethylethylacrylate [AA(ME)A] are substituted for AAEMA. Portions of the latex are employed to impregnate non-woven filter paper at pH 2.8 and pH 6, and the samples are cured and tested for water-wet and PCE tensile as described in Example 13. The results of these evaluations are given in Table 4.

EXAMPLE 15

The polymerization and product testing procedures described in Example 13 are again repeated with the exception that 29.2 grams of acetoacetoxy-n-butylacrylate [AA(n-$C_4$)A] are substituted for AAEMA. Results of wet and PCE tensiles at pH 2.8 and pH 6 are reported in Table 4.

EXAMPLE 16

The polymerization and product evaluation described in Example 13 is repeated with the exception that 29.2 grams of acetoacetoxy-n-hexylacrylate [AA(n-$C_6$)A] are substituted for AAEMA. Wet and PCE tensiles at pH 2.7 and pH 6 are reported in Table 4.

EXAMPLE 17

The polymerization and product evaluation conditions and procedures described in Example 13 are repeated substituting 29.2 grams of acetoacetoxy-2,2-diethylpropylacrylate [AA(diEt$C_3$)A] for AAEMA. Wet and PCE tensiles at pH 2.7 and pH 6 are reported in Table 4.

EXAMPLE 18

The polymerization and product evaluation procedures and conditions described in Example 13 are repeated with the exception that 29.2 grams of allylacetate are substituted for AAEMA. Wet and PCE tensiles at pH 3.0 and pH 6 are reported in Table 4.

EXAMPLE 19

The polymerization and product evaluation procedures and conditions described in Example 13 are repeated substituting 29.2 grams of acetoxyethylacrylate for AAEMA, and wet and PCE tensile values at pH 3.0 and pH 6 are reported in Table 4.

TABLE 4

| Ex. No. | Added Monomer | Monomer[a] Mol. Wt. | Tensile, lb. pH 2.7–3.0 Wet | pH 2.7–3.0 PCE | pH 6 Wet | pH 6 PCE | % Solids | Visc., Cp. 21° C. |
|---|---|---|---|---|---|---|---|---|
| 13 | AAEMA | 200 | 4.9 | 6.0 | 7.0 | 8.2 | 45 | 64 |
| 14 | AA(ME)A | 214 | 6.2 | 6.4 | 6.3 | 8.3 | 45 | 48 |
| 15 | AA(n-$C_4$)A | 228 | 5.4 | 6.7 | 7.1 | 8.4 | 45 | 42 |
| 16 | AA(n-$C_6$)A | 256 | 4.7 | 6.5 | 5.7 | 8.1 | 45 | 36 |
| 17 | AA(diEt$C_3$)A | 270 | 4.6 | 6.8 | 5.0 | 8.6 | 44 | 30 |
| 18 | Allyl AA | 142 | 4.4 | 5.4 | 4.4 | 5.0 | 45 | 52 |
| 19 | Acetoxyethyl-acrylate | 158 | 3.6 | 3.8 | 3.0 | 4.9 | 45 | 36 |

[a]Monomer molecular weight.

These results demonstrate that both the wet and PCE tensiles of polymers containing the useful monomers are consistently higher at both pH levels than are tensiles obtained with polymers containing monomers in which the "active" methylene group bridging the two carbonyls is separated from the polymer backbone by only 3 atoms as in the case of allylacetoacetate (Example 18). The values obtained with polymers containing the useful monomers are also consistently higher than those obtained with polymers containing a single keto group in the functional monomer as in the case of acetoxyethylacrylate (Example 19). Since the weight percentages of all monomers were maintained the same (5 weight percent in each case), the molar concentration of monomer decreased as monomer molecular weight increased. Reducing the molarity of the useful monomer reduces the molarity of the active functional group—the "active" methylene bridging the two carbonyls. This reduction in molarity may account for the apparent reduction in wet tensile strength at both pH levels as molecular weight increased. Furthermore, it is demonstrated that allylacetoacetate, having a molecular weight of 142, achieved a wet tensile strength of 4.4 in contrast to a wet tensile of 4.6 produced by roughly half the moles of acetoacetoxy-2,2-diethylpropylacrylate which has a molecular weight of 270. Thus, substantial benefits in physical properties are achieved by introducing into the polymer backbone methylene groups bridging 2 carbonyl groups, which methylene groups are spaced from the polymer backbone by more than 3 atoms.

While particular embodiments of the invention have been described, it will be understood, of course, that the invention is not limited to these embodiments, since many obvious modifications can be made, and it is intended to include within this invention any such modifications as will fall within the scope of the appended claims.

We claim:

1. A method for producing a bonded textile article which comprises contacting a plurality of fibers with a solution of dispersion of a polymer comprising at least about 10 weight percent polymerized, olefinically unsaturated carboxylic acid ester monomers and at least about 0.5 weight percent of at least one polymerizable functional monomer of the formula:

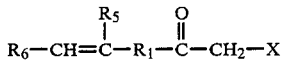

in which $R_1$ is a divalent organic radical of at least 3 atoms in length, $R_5$ and $R_6$ are independently selected from hydrogen, hydroxy, halo, thio, amino or monovalent organic radicals, and X is —CO—$R_4$ or —CN wherein $R_4$ is hydrogen or a monovalent organic radical having up to about 10 atoms other than hydrogen under conditions sufficient to combine said polymer with and bond said fibers together.

2. The method defined in claim 1 wherein said plurality of fibers is contacted with an aqueous dispersion of said polymer.

3. The method defined in claim 1 wherein said plurality of fibers is contacted with a solution of said polymer.

4. The method defined in claim 2 wherein said aqueous dispersion is contacted with said fibers at a pH within the range of about 4 to about 8.

5. The method defined in claim 2 wherein said aqueous dispersion is contacted with said fibers at a pH of at least about 4.

6. The method defined in claim 2 wherein said aqueous dispersion is contacted with said fibers at a pH of at least about 6.

7. The method defined in claim 1 wherein $R_1$ is selected from cyclic and acyclic divalent organic radicals having 2 to about 40 carbon atoms.

8. The method defined in claim 2 wherein said aqueous dispersion comprises at least about 20 weight percent of said polymer and at least about 5 weight percent, based on the total wet weight of said dispersion, of dispersed matter other than said polymer.

9. The method defined in claim 8 wherein said dispersed matter other than said polymer is selected from the group consisting of fillers, pigments, and combinations thereof.

10. The method defined in claim 8 wherein said aqueous dispersion comprises at least about 10 weight percent of said dispersed matter based on the total wet weight of said dispersion.

11. The method defined in claim 1 wherein said fibers are contacted with said solution or dispersion under conditions sufficient to combine at least about 1 weight percent of said polymer with said fibers based on the finished weight of said textile article.

12. The method defined in claim 2 wherein said polymer co at least about 0.5 weight percent of at least one monomer having the formula:

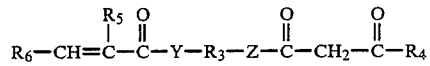

wherein $R_4$, $R_5$, and $R_6$ are as defined in claim 1, $R_3$ is a divalent organic radical having at least one atom, and Y and Z are independently selected from the group consisting of O, S, and $NR_7$, and $R_7$ is H or hydrocarbyl.

13. The method defined in claim 12 wherein said polymer cases at least about 30 weight percent of said carboxylic acid ester monomers, and wherein $R_4$ is hydrogen or alkyl having up to about 8 carbon atoms, and $R_4$ is a divalent organic radical 2 to about 20 atoms in length.

14. The method defined in claim 13 wherein each of Y and Z is O.

15. The method defined in claim 2 wherein said polymer comprises about 1 to about 10 weight percent of a member selected from the group consisting of acetoacetoxy-ethyl-methacrylate, acetoacetoxyethylacrylate, and combinations thereof, and at least about 30 weight percent of other carboxylic acid ester monomers.

16. The method defined in claim 1 wherein said fibers contain polar functional groups selected from the group consisting of hydroxy, carbonyl, carboxylic acid ester, thioester, amide, and amine groups and combinations thereof.

17. The method defined in claim 1 wherein said textile m is selected from the group consisting of wovens, non-wovens, knits, threads, yarns and ropes, and said functional monomer constitutes at least about 1 weight percent of said polymer.

18. The method defined in claim 2 wherein said textile material comprises a non-woven textile assembly, and said fibers contain functional groups selected from the group consisting of hydroxy, carbonyl, carboxylic acid ester, thioester, amide and amine groups, and combinations thereof.

19. The method defined in claim 1 wherein said polymer c less than about 1 weight percent of N-methylolamide monomers.

20. The method defined in claim 1 wherein said polymer is free of N-methylolamide monomers.

21. The method defined in claim 1 wherein said solution of dispersion is substantially free of crosslinking agents.

22. The method defined in claim 1 wherein said polymer comprises a polymerizable acid monomer.

23. The method defined in claim 1 wherein said polymer further comprises at least about 0.1 weight percent of a polymerizable acid selected from the group consisting of olefinically-unsaturated carboxylic acids having up to about 10 carbon atoms, sulfoalkyl esters of said olefinically-unsaturated acids, and combinations thereof.

24. A method for producing a bonded textile material which comprises an assembly consisting essentially of textile fibers containing polar functional groups with an amount of a solution or dispersion of a polymer sufficient to bond said fibers together, said polymers comprising at least about 10 weight percent carboxylic acid ester monomers and at least about 0.5 weight percent pendant functional groups of the formula:

$$-R_1-\overset{O}{\overset{\|}{C}}-CH_2-\overset{O}{\overset{\|}{C}}-R_4$$

wherein $R_1$ is a divalent organic radical at least 3 atoms in length, and $R_4$ is H or a monovalent organic radical having up to about 10 atoms other than hydrogen.

25. The method defined in claim 24 wherein said polymer comprises at least about 50 weight percent carboxylic acid ester monomers and less than about 1 weight percent N-methylolamide monomers, said fibers contain functional groups selected from the group consisting of hydroxy, carbonyl, carboxylic acid ester, thioester amide, and amine groups and combinations thereof, and said textile material is selected from the group consisting of wovens, non-wovens, knits, threads, yarns and ropes, and comprises at least about 0.2 weight percent of said polymer.

26. The method defined in claim 24 wherein said polymer comprises at least about 50 weight percent carboxylic acid ester monomers and less than about 1 weight percent N-methylolamide monomers, said fibers contain functional groups selected from the group consisting of hydroxy, carbonyl, carboxylic acid ester, thioester, amide, and amine groups and combinations thereof, and said textile material comprises a non-woven textile and at least about 0.2 weight percent of said polymer.

27. The method defined in claim 26 wherein said polymer is substantially free of N-methylolamide groups.

28. The method defined in claim 26 wherein said polymer is substantially free of crosslinking agents and residues thereof.

29. The method defined in claim 26 wherein $R_1$ is of the formula:

$$-\overset{O}{\overset{\|}{C}}-Y-R_3-Z-$$

wherein Y and Z are independently selected from the group consisting of oxygen, sulfur, and $NR_7$, $R_3$ is a divalent organic radical about 2 to about 40 atoms in length, and $R_7$ is H or hydrocarbyl.

30. The method defined in claim 29 wherein $R_3$ is selected from the group consisting of substituted and unsubstituted alkylene, alkylene-oxy, alkyleneimine, and alkylene-thio radicals.

31. The method defined in claim 24 wherein $R_1$ is an ethylene radical, $R_4$ is a methyl radical, said fibers contain functional groups selected from the group consisting of hydroxy, carbonyl, carboxylic acid ester, thioester, amide, and amine groups and combinations thereof, said textile comprises a non-woven textile containing at least about 0.2 weight percent of said polymer, and said polymer contains less than about 1 weight percent N-methylolamide monomers.

32. A method for producing a bonded, non-woven fiber assemblage which comprises contacting a non-woven assemblage of fibers with a solution or dispersion of a polymer comprising at least about 10 weight percent polymerized, olefinically unsaturated ester monomers and at least about 0.5 weight percent pendant groups of the formula:

$$-R_3-O-\overset{O}{\overset{\|}{C}}-CH_2-\overset{O}{\overset{\|}{C}}-R_4$$

wherein $R_3$ is a divalent organic radical at least 2 atoms in length, $R_4$ is hydrogen or an organic radical having up to about 10 atoms other than hydrogen, and said assemblage of fibers is contacted with said solution or dispersion under conditions sufficient to bond said fibers with said polymer.

33. A method for producing a bonded non-woven which comprises contacting a non-woven assemblage with a solution or dispersion of a polymer comprising at least about 10 weight percent polymerized, olefinically unsaturated carboxylic acid ester monomers and at least about 0.5 weight percent of monomers of the formula:

$$R_6-CH=\overset{R_5}{\overset{|}{C}}-R_1-\overset{O}{\overset{\|}{C}}-CH_2-X$$

in which $R_1$ is a divalent organic radical of at least 3 atoms in length, $R_5$ and $R_6$ are independently selected from hydrogen, hydroxy, halo, thio, amino or monovalent organic radicals, and X is $-CO-R_4$ or $-CN$, wherein $R_4$ is hydrogen or a monovalent organic radical having up to about 10 atoms other than hydrogen, under conditions sufficient to bond said non-woven assemblage with said polymer.

34. The method defined in claim 33 wherein said polymer is contacted with said assemblage at a pH of about 4 to about 12.

35. The method defined in claim 33 wherein said polymer is contacted with said assemblage at a pH within the range of about 4 to about 8.

36. The method defined in claim 33 wherein said non-woven assemblage is contacted with an aqueous dispersion of said polymer comprising at least about 30 weight percent of said polymer and at least about 5 weight percent of undissolved dispersed matter other than said polymer.

37. The method defined in claim 33 wherein said polymer is substantially free of N-methylolamide monomers.

* * * * *

UNITED STATES PATENT AND TRADEMARK OFFICE

CERTIFICATE OF CORRECTION

PATENT NO. : 4,966,791

DATED : October 30, 1990

INVENTOR(S) : Kissel et al.

It is certified that error appears in the above-identified patent and that said Letters Patent is hereby corrected as shown below:

Col. 19, claim 1, line 40, "of" (first occur) should be --or--; line 53, "CN" should be --cn- --;
Col. 20, claim 12, line 27, "co" should be --comprises--;
Col. 20, claim 13, line 39, "cases" should be --comprises--;
Col. 20, claim 15, line 49, delete "-" after toxy;
Col. 20, claim 17, line 59, "m" should be --material--;
Col. 21, claim 19, line 2, "c" should be --comprises--;
Col. 21, claim 21, line 7, "of" (first occur) should be --or--;
Col. 21, claim 24, line 19, after "comprises" insert --contacting--;
Col. 21, claim 25, line 39, after "thioester" insert --,--.

Signed and Sealed this

Tenth Day of March, 1992

*Attest:*

HARRY F. MANBECK, JR.

*Attesting Officer*

*Commissioner of Patents and Trademarks*